US006328414B1

(12) United States Patent
Yoshino

(10) Patent No.: US 6,328,414 B1
(45) **Date of Patent: *Dec. 11, 2001**

(54) PRINTING APPARATUS, PRINTING HEAD UNIT, LIQUID TANK UNIT AND PRINTING METHOD

(75) Inventor: Hiroshi Yoshino, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/812,159

(22) Filed: Mar. 6, 1997

(30) Foreign Application Priority Data

Mar. 11, 1996 (JP) ..... 8-053354

(51) Int. Cl.[7] ..... B41J 2/165; B41J 2/17

(52) U.S. Cl. ..... 347/36; 347/96

(58) Field of Search ..... 347/36, 96, 98, 347/101, 85–87, 43, 19, 35

(56) References Cited

U.S. PATENT DOCUMENTS

| | | | | |
|---|---|---|---|---|
| 4,380,771 | * | 4/1983 | Takatori | 347/43 |
| 4,965,596 | * | 10/1990 | Nagoshi et al. | 347/85 |
| 5,023,629 | * | 6/1991 | Kiyohara | 347/36 |
| 5,113,206 | * | 5/1992 | Fukazawa | 347/86 |
| 5,221,935 | * | 6/1993 | Uzita | 347/85 |
| 5,485,187 | * | 1/1996 | Okamura et al. | 347/85 |
| 5,640,187 | | 6/1997 | Kashiwazaki et al. | 347/101 |
| 5,680,162 | * | 10/1997 | Taylor et al. | 347/35 |
| 5,929,885 | * | 7/1999 | Nakjima et al. | 347/87 |
| 6,120,141 | * | 9/2000 | Tajika et al. | 347/96 |

FOREIGN PATENT DOCUMENTS

| | | | |
|---|---|---|---|
| 56-89567 | | 7/1981 | (JP) . |
| 60-85964 | | 5/1983 | (JP) . |
| 58128862 | | 8/1983 | (JP) . |
| 61-35962 | * | 2/1986 | (JP) . |
| 3-247460 | | 11/1991 | (JP) . |
| 5-162328 | * | 6/1993 | (JP) . |
| 6-92009 | | 4/1994 | (JP) . |
| 0 625 424 | | 11/1994 | (JP) . |
| 6-328711 | | 11/1994 | (JP) . |
| 7-60964 | | 3/1995 | (JP) . |
| 9-24618 | | 1/1997 | (JP) . |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The present invention is concerned with an ink jet printing apparatus which assures that even though malfunctions of leakage of ink and leakage of treatment liquid occur, an operation of the printing apparatus and each printing operation to be performed by the printing apparatus are not adversely affected. According to the present invention, the printing apparatus includes an ink head restoring device for performing restoring for the ink head by sucking ink from the ink head, an ink drain tank for receiving the ink sucked by the sucking operation of the ink head restoring device, leaked ink conducting device for conducting the ink leaked from the ink supplying tank to the ink drain tank, treatment liquid restoring device for performing restoring for the treatment liquid head by sucking treatment liquid from the treatment liquid head, a treatment liquid drain tank for receiving the treatment liquid sucked by the sucking operation of the treatment liquid head restoring device, and leaked treatment liquid conducting device for conducting the treatment liquid leaked from the treatment liquid supplying tank to the treatment liquid drain tank.

15 Claims, 12 Drawing Sheets

PRINTING APPARATUS, PRINTING HEAD UNIT, LIQUID TANK UNIT AND PRINTING METHOD

BACKGROUND OF THE INVENTION

Field of the Invention

The present invention relates to a printing apparatus for performing a printing for a printing medium with the use of an ink head for ejecting ink and a treatment liquid head for ejecting treatment liquid to control printing properties of the ink, a printing head unit usable for the printing apparatus, a liquid tank unit adapted to be mounted on the printing head unit, and a printing method.

In recent years, with respect to an ink jet printing apparatus for forming an image by ejecting ink from a printing head to a printing medium such as a paper, a film, a cloth or the like (hereinafter referred to as a printing sheet), a technology having treatment liquid additionally used for improving water resistance of the ink and controlling properties of the ink so as to print an image with high quality. The treatment liquid has a function for suppressing the blur of the ink by suppressing the penetration of the ink to the printing sheet or promoting the drying of the ink. The treatment liquid is ejected to the printing sheet before the ink is ejected or the treatment liquid is ejected to the printing sheet directly after the ink is ejected. An ink jet printing apparatus of the foregoing type is known as disclosed in Japanese Patent Application Laying-open No. 15-128862.

A conventional ink jet printing apparatus is basically designed so as not to allow the ink to leak from an ink supplying tank. However, there is a fear that ink leaks from a connecting portion between a printing head and an ink supplying tank for some reason, e.g., radical variation of the atmosphere pressure exerted on the ink supplying tank. For this reason, there arises a necessity that printing operation is not incorrectly performed even though the ink leaks in the aforementioned manner. For example, Japanese Patent Application Laying-open No. 60-85964 discloses a dish-like member for receiving the leaked ink from the ink supplying system, the whole ink supplying system arranged on the dish-like member. In addition, there is known the printing apparatus that while the bottom of a housing have not any opening portion so as not to leak the ink. In addition, Japanese Patent Application Laying-open No. 09-024618 discloses that the ink leaked from an ink supplying system is conducted to a specific discharging passage arranged in the printing apparatus, and moreover, the ink is additionally conducted to an ink drain tank from the discharging passage.

With respect to an ink jet printing apparatus adapted to perform a printing by ejecting to a printing sheet the treatment liquid to control printing properties of ink before the ink is ejected or after it is ejected, in the case that a conventional measure is employed to the printing apparatus for ink leakage, there appear problems as noted below when leakage of both of the ink and the treatment liquid occurs.

(1) In the case that a technology for completely covering the bottom of the printing apparatus is employed, there is a fear that the ink and the treatment liquid react with each other and they are solidified, causing the vicinity of a supplying port for supplying ink from an ink supplying portion to a printing head to be closed due to the solidification of the ink and the treatment liquid, and moreover, sealing properties of a printing head relative to the surface of a plurality of ejecting ports are degraded due to adhesion of the solidified ink to a cap head disposed for the printing head.

(2) In the case that the technology for conducting leaked ink to an ink drain tank via a specific discharging passage is employed, there is a fear that the discharging passage is closed due to the reaction of the leaked ink with the leaked treatment liquid in the discharging passage. Thus, there is a fear that the ink or the treatment liquid which leaks later flows out from the discharging passage into the interior of the printing apparatus or flows out from the printing apparatus and it is then solidified with the result that the printing apparatus and associated components are seriously damaged.

SUMMARY OF THE INVENTION

An object of the present invention is to provide a printing apparatus which can prevent an occurrence of malfunction that the printing apparatus and printing operation are not adversely affected even though both of ink and treatment liquid leak in the case that a printing operation is performed for a printing medium with the use of an ink head for ejecting ink and a treatment liquid head for ejecting treatment liquid to control printing properties of the ink.

Other object of the present invention is to provide a printing head unit used for the printing apparatus.

Another object of the present invention is to provide a liquid supplying tank to be mounted on the printing head unit.

Further another object of the present invention is to provide a method of controlling the printing apparatus.

According to a first aspect of the present invention, there is provided a printing apparatus for performing a printing for a printing medium with the use of an ink head having a plurality of ink ejecting ports formed thereon for ejecting ink supplied from a first ink supplying tank storing the ink and a treatment liquid head having a plurality of treatment liquid ejecting ports formed thereon for ejecting treatment liquid supplied from a first treatment liquid supplying tank storing the treatment liquid to control printing properties of the ink, wherein the printing apparatus comprises;

ink head restoring means for performing restoring for the ink head by sucking ink from the ink ejecting ports, an ink drain tank for receiving the ink sucked by the sucking operation of the ink head restoring means, leaked ink conducting means for conducting the ink leaked from the first ink supplying tank to the ink drain tank, treatment liquid restoring means for performing restoring for the treatment liquid head by sucking treatment liquid from the treatment liquid ejecting ports, a treatment liquid drain tank for receiving the treatment liquid sucked by the sucking operation of the treatment liquid head restoring means, and leaked treatment liquid conducting means for conducting the treatment liquid leaked from the first treatment liquid supplying tank to the treatment liquid drain tank.

With respect to the printing apparatus constructed according to the first aspect of the present invention, in the case that the ink-leak from the ink supplying tank connected to the printing head and/or the treatment liquid leak from the treatment liquid supplying tank connected to the printing head, the leaked ink is conducted to the ink drain tank via leaked ink conducting means and the leaked treatment liquid is conducted to the treatment liquid drain tank via leaked treatment liquid conducting means. Thus, the ink and the treatment liquid sucked at the time when the printing head is restored are conducted without any occurrence of mixing and solidification during the ink and the treatment liquid are conducted by utilizing the ink drain tank for receiving the ink therein and the treatment liquid drain tank for receiving the treatment liquid therein.

In the printing apparatus constructed according to the first aspect of the present invention, the first ink supplying tank includes the ink supplying port and the first treatment liquid supplying tank includes the treatment liquid supplying port, and the first ink supplying tank may be detachably attached to the ink head via the ink supplying port and the first treatment liquid supplying tank may be detachably attached to the treatment liquid head via the treatment liquid supplying port. In this case, leakage of the ink from the first ink supplying tank occur from the vicinity of the ink supplying port and leakage of the treatment liquid from the first treatment liquid supplying tank occur from the vicinity of the treatment liquid supplying port.

The printing apparatus may further include a printing head unit structured by combining the ink head and the treatment liquid head integrally, the enclosed space for separately conducting the ink leaked from the first ink supplying tank and the treatment liquid leaked from the first treatment liquid supplying tank is defined between the printing head unit and the first ink and treatment liquid supplying tanks, the ink leaked from the first ink supplying tank is conducted to the ink drain tank by the leaked ink conducting means via the enclosed space, and the treatment liquid leaked from the treatment liquid supplying tank is conducted to the treatment liquid drain tank by the leaked treatment liquid conducting means via the enclosed space.

On the other hand, the second ink supplying tank for receiving ink to be supplemented to the first ink supplying tank and forming the ink supplementing port connected to the first ink supplying tank can additionally be connected to the first ink supplying tank, the second ink supplying tank can be displaced to the supplementing position where the ink can be supplemented to the first ink supplying tank and the standby position where no ink is supplemented, and the second treatment liquid supplying tank for receiving the treatment liquid to be supplemented to the first treatment liquid supplying tank and forming the treatment liquid supplying port connected to the first treatment liquid supplying tank can additionally be connected to the first treatment liquid supplying tank, the second treatment liquid supplying tank can be displaced to the supplementing position where the treatment liquid can be supplemented to the first treatment liquid supplying tank and the standby position where no treatment liquid is supplemented. In this case, leakage of the ink from the ink supplying tank occur from the vicinity of the ink supplying ports of the first and second ink supplying tanks and leakage of treatment liquid from the treatment liquid supplying tank occur from the vicinity of the treatment liquid supplying ports of the first and second treatment liquid supplying tanks. In addition, the printing apparatus may further include a printing head unit structured by combining the ink head and the treatment liquid head integrally, the enclosed space for separately conducting the ink leaked from the first ink supplying tank and the treatment liquid leaked from the first treatment liquid supplying tank is defined between the printing head unit and the first ink and treatment liquid supplying tanks, the first ink supplying tank includes a leaked ink discharging passage for conducting the ink leaked from the second ink supplying tank, and the first treatment liquid supplying tank includes a leaked treatment liquid discharging passage for conducting the treatment liquid leaked from the second treatment liquid supplying tank, and the ink leaked from the first and second ink supplying tanks is conducted to the ink drain tank by the leaked ink conducting means via the enclosed space, and the treatment liquid leaked from the first and second treatment liquid supplying tanks is conducted to the treatment liquid drain tank by the leaked treatment liquid conducting means via the enclosed space.

In other words, the second ink supplying tank is displaced from the standby position to the supplementing position, and the ink is supplemented to the first ink supplying tanks while the second ink supplying tank is connected to the first ink supplying tank. The second treatment liquid supplying tank is displaced from the standby position to the supplementing position, and the treatment liquid is supplemented to the first treatment liquid supplying tank while the second treatment liquid supplying tank is connected to the first treatment liquid supplying tank. After supplementing of the ink and the treatment liquid is completed, the second ink and treatment liquid supplying tanks are evacuated from the supplementing position to the standby position, and the ink and the treatment liquid required for printing operations to the time being are held on the first ink and treatment liquid supplying tanks.

The ink leaked from the first and second ink supplying tanks are conducted in the ink drain tank by the leaked ink conducting means without any occurrence of solidification and the treatment liquid leaked from the first and second treatment liquid supplying tanks are conducted in the treatment liquid drain tank by the leaked liquid conducting means without any occurrence of solidification, respectively.

The enclosed space can be defined by a rib for separately surrounding the periphery of an ink supplementing port formed into the printing head unit and connected to the ink supplying port of the first ink supplying tank, and the periphery of a treatment liquid supplying port formed into the printing head unit and connected to the treatment supplying port and wall surfaces on the ink supplying port of the first ink supplying tank and the treatment liquid tank supplying port of the first treatment liquid supplying tank. The rib may include an opening portion for conducting the leaked ink to the leaked ink conducting means, and an opening portion for conducting the leaked treatment liquid to the leaked treatment liquid conducting means.

The printing apparatus may further include leakage detecting means located at the position associated with the leaked ink conducting means and the leaked treatment liquid conducting means. In this case, the leakage detecting means may be an optical sensor such as a reflective type photointerrupter or the like. In addition, the printing apparatus may further include a transparent container to which at least a part of the ink conducted to the ink drain tank and the treatment liquid conducted to the treatment liquid drain tank is conducted, and the optical sensor may be an instrument for detecting the ink and the treatment liquid conducted to the container. In this case, it is desirous that the container can be exchanged with another one. In addition, the leakage detecting means may be an instrument which can further detect the presence or absence of the ink in the first ink supplying tank and the treatment liquid in the first treatment liquid supplying tank. It is also possible that the printing apparatus further include informing means for informing the result of the detection executed by the leakage detecting means. In this case, the informing means may be means which includes at least one of the displaying means and alarm generating means. Additionally, the leaked ink conducting means may be means which includes an inclined flow passage for conducting the leaked ink to said ink drain tank and said leaked treatment liquid conducting means includes an inclined flow passage for conducting the leaked treatment liquid to said treatment liquid drain tank and a pair of cutout portions formed at the intermediate part of said inclined flow passages for conducting respectively to said container the ink and the treatment liquid leaked in excess of a predetermined flow rate. The ink head conducting means and the treatment liquid head conducting means may be means which includes ink sucking means and treatment liquid sucking means, respectively.

The first and second ink supplying tanks may be received plural kinds of color inks, respectively, and the ink head can perform a color printing by ejecting plural kinds of color inks.

The ink head may dispose a plurality of ejecting energy generating portions for ejecting ink therefrom and the treatment liquid head may dispose a plurality of ejecting energy generating portions for ejecting treatment liquid therefrom, and the ejecting energy generating portions may include an electrothermal transducer which serves to generate thermal energy so as to cause a phenomenon of film boiling to arise with liquid, respectively.

In addition, according to a second aspect of the present invention, there is provided a printing head unit including an ink head having a plurality of ink ejecting ports formed thereon for ejecting the ink, a connecting portion associated with an ink supplying tank storing ink to be supplied to the ink head, a treatment liquid head having a plurality of treatment liquid ejecting ports formed thereon for ejecting the treatment liquid to control printing properties of the ink, and a connecting portion associated with a treatment liquid supplying tank storing treatment liquid to be supplied to the treatment liquid head, wherein the printing head unit comprises;

an ink supplementing port connected to an ink supplying port of the ink supplying tank, a treatment liquid supplementing port connected to a treatment liquid supplying port of the treatment liquid supplying tank, a rib for surrounding the periphery of the ink supplementing port and defining a enclosed space for conducting the ink leaked from wall surface of the ink supplying tank, and for surrounding the periphery of the treatment liquid supplementing port and defining a enclosed space for conducting the treatment liquid leaked from wall surface of the treatment liquid supplying tank, an ink discharging opening portion defined on the rib for discharging the ink in the enclosed space to which the ink supplementing port is exposed, and a treatment liquid discharging opening portion defined on the rib for discharging the treatment liquid in the enclosed space to which the treatment liquid supplementing port is exposed.

With respect to the printing head unit constructed according to the second aspect of the present invention, the ink leaked from the ink supplying tank is discharged from the ink discharging opening portion and the treatment liquid leaked from the treatment liquid supplying tank is discharged from the treatment liquid discharging opening portion, without any occurrence of mixing with each other by the rib which defines the enclosed space in cooperation with the wall surfaces of the ink supplying tank and the treatment liquid supplying tank.

With respect to the printing head unit constructed according to the second aspect of the present invention, the ink supplying tank may be detachably attached to the ink head and the treatment liquid supplying tank may be detachably attached to the treatment liquid head.

Leakage of the ink occur from the vicinity of the ink supplying port and leakage of the treatment liquid occur from the vicinity of the treatment liquid supplying port.

In addition, the ink head may be disposed a plurality of ejecting energy generating portions for ejecting the ink therefrom and the treatment liquid head may be disposed a plurality of ejecting energy generating portions for ejecting the treatment liquid therefrom, and each of the ejecting energy generating portions may be included an electrothermal transducer for generating thermal energy so as to cause a phenomenon of film boiling to arise with liquid, respectively.

Additionally, according to a third aspect of the present invention, there is provided a liquid tank unit detachably connected to a printing head unit including an ink head having a plurality of ink ejecting ports formed thereon for ejecting the ink so as to allow the ink supplied to the printing head unit, and including a treatment liquid head having a plurality of treatment liquid ejecting ports formed thereon for ejecting the treatment liquid to control printing properties of the ink formed thereon so as to allow the treatment liquid supplied to the printing head unit, the liquid tank unit including connecting portions to an ink supplementing tank and a treatment liquid supplementing tank so as to supply the ink in the ink supplementing tank and the treatment liquid in the treatment liquid supplementing tank to the printing head unit, wherein the liquid tank unit comprises;

a leaked ink discharging passage for conducting the ink leaked from the ink supplementing tank to a enclosed space defined between the printing head unit and the liquid tank unit, and a leaked treatment liquid discharging passage for conducting the treatment liquid leaked from the treatment liquid supplementing tank to the enclosed space separately from the ink.

Further, according to a fourth aspect of the present invention, there is provided a printing method of performing a printing for a printing medium with the use of an ink head for ejecting the ink supplied from an ink supplying tank storing the ink and a treatment liquid head for ejecting the treatment liquid supplied from a treatment liquid supplying tank storing the treatment liquid to control printing properties of the ink, wherein the printing method comprises;

a step for detecting the presence or absence of ink leakage between the ink supplying tank and the ink head, a step for detecting the presence or absence of treatment liquid leakage between the treatment supplying tank and the treatment liquid head, and a step for informing an occurrence of leakage of ink or treatment liquid in the case that ink leakage or treatment liquid leakage occurs, and then for stopping the printing operation.

With respect to the printing method practiced according to the fourth aspect of the present invention, when leakage of ink occurs between the ink head for ejecting the ink and the ink supplying tank for receiving the ink and leakage of treatment liquid occurs between the treatment liquid head for ejecting the treatment liquid and the treatment liquid supplying tank for receiving the treatment liquid, an occurrence of leakage of the ink and the treatment liquid is detected and informed to the user, and printing operation is stopped.

With respect to the printing method practiced according to the fourth aspect of the present invention, information of leakage of the ink and/or leakage of the treatment liquid may be performed by utilizing at least one of visual checking and auditory checking.

In addition, the ink head may be disposed a plurality of ejecting energy generating portions and the treatment liquid head may be disposed a plurality of ejecting energy generating portions, and each of the ejecting energy generating portions may be an energy generating portion which includes an electrothermal transducer for generating thermal energy for causing a phenomenon of film boiling to arise with liquid.

According to the present invention, since the printing apparatus is constructed such that it is completely separated into two systems, i.e., a conducting system for the leaked ink and a conducting system for the leaked treatment liquid, contamination of the interior of the printing apparatus with the leaked liquid can be suppressed to a minimum limit, leakage of the ink or the treatment liquid from the printing apparatus can be prevented, and moreover, the printing apparatus can be constructed with reduced dimensions.

Even in the case that leakage of the ink occurs from the periphery of the ink supplying port and leakage of the treatment liquid occurs from the periphery of the treatment liquid supplying port, adhesion of the ink and the treatment liquid to the vicinity of the ink supplying port of the ink supplying tank and the vicinity of the treatment liquid supplying port of the treatment liquid supplying tank due to mixing of the ink and the treatment liquid with each other can be prevented by forming the defined port between the ink head and the treatment liquid head as well as between the ink supplying tank and the treatment liquid supplying tank so as not to allow the ink and the treatment liquid to mix with each other. Consequently, a printing apparatus having high reliability can be provided according to the present invention.

Further, in the case that leakage detecting means for the ink and the treatment liquid and informing means for informing the result of detection performed by the leakage detecting means are arranged on the printing apparatus, a caution for an occurrence of leakage of the ink and the treatment liquid can promotively be given to users, dispersion of the ink and the treatment liquid leaked in the interior of the printing apparatus can be prevented, and moreover, the interior of the printing apparatus can be kept clean. In the case that an optical sensor, especially, a reflective type photointerrupter is used as detecting means of the foregoing type, a large quantity of leakage of the liquid can be detected at a lowest cost required for the detection with simple structure. In the case that displaying means and alarm generating means are employed as informing means, information to the user becomes simple. Additionally, not only contamination and injury or damage of the printing apparatus with the leaked liquid can be prevented by arranging an exchangeable container above the optical sensor but also an operational efficiency of each maintaining operation for the printing apparatus can be improved.

In the case that the leakage detecting means of the leakage detecting means is constructed so as to enable it to detect the presence or absence of the ink and the treatment liquid in the ink supplying tank and the treatment liquid supplying tank, the printing apparatus can be operated at a reduced cost.

When the printing apparatus of the present invention is used as a network printer by incorporating the informing means in a software for the printer, information to the user becomes easy.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Embodiments of an ink jet printing apparatus according to the present invention will be described below in detail with reference to FIG. 1 to FIG. 17.

Figure 1:
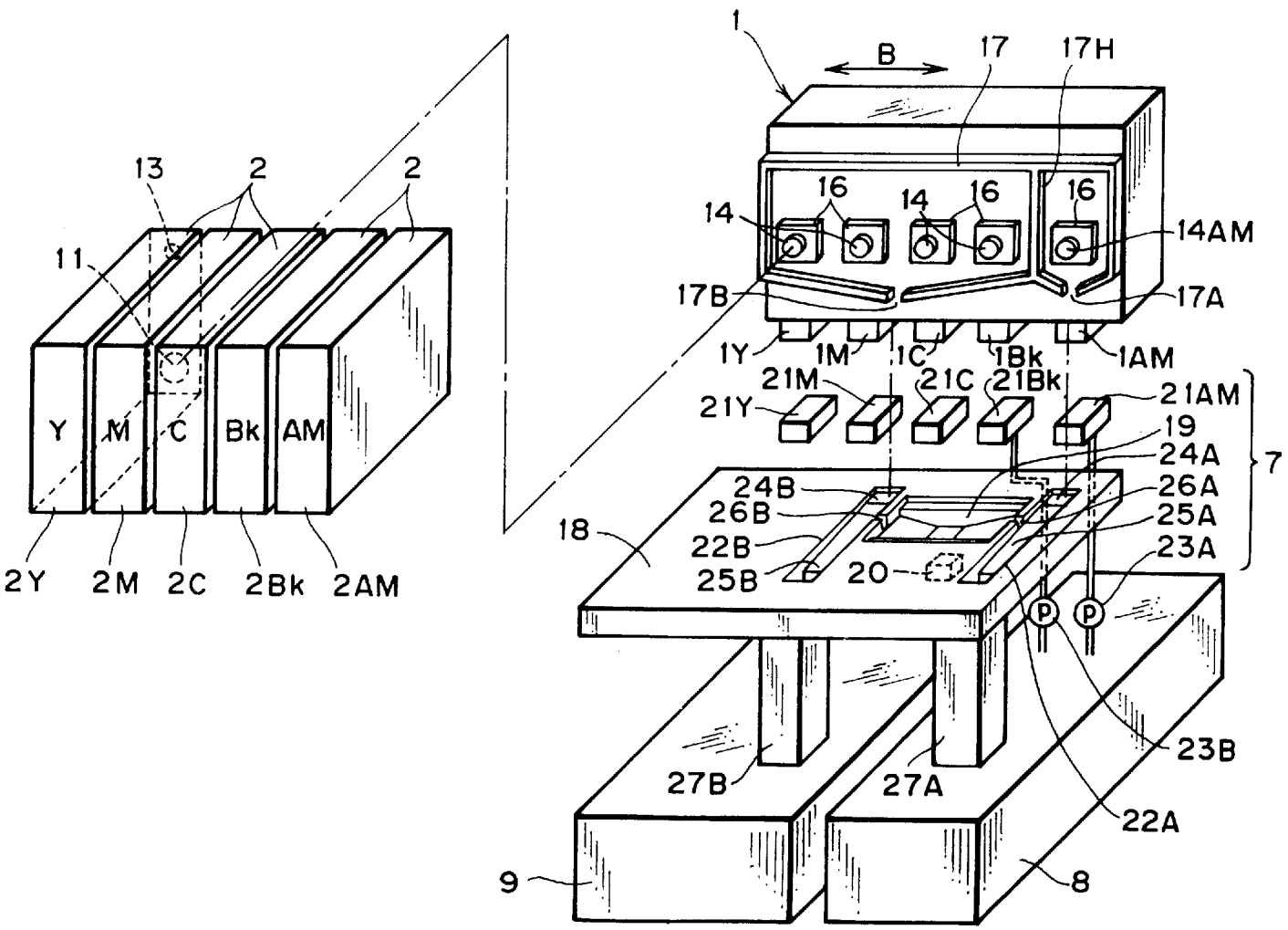
FIG. 1 is a perspective view showing the schematic structure of main components of an ink jet printing apparatus in the disassembled state according to a first embodiment of the present invention.
Figure 2:
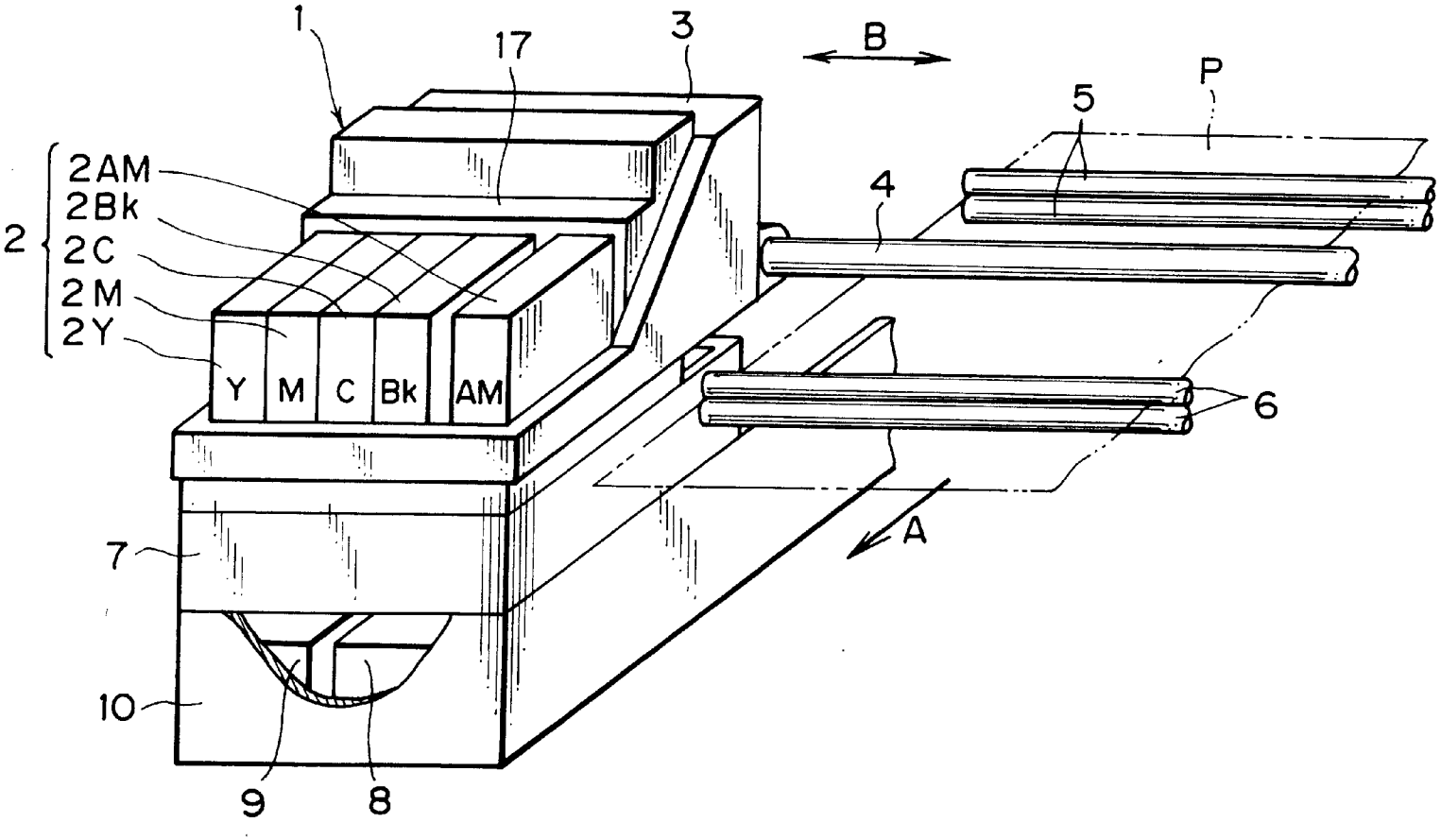
FIG. 2 is a perspective view showing an appearance of main components of the printing apparatus in the exploded state according to the first embodiment of the present invention.

FIG. 1 and FIG. 2 show a first embodiment of the present invention. FIG. 1 shows in the disassembled state the structure of a printing head unit 1 conducted to a home position of the printing apparatus, supplying tanks 2Y, 2M, 2C, 2B*k* and 2AM (hereinafter, all of these supplying tanks are occasionally represented by a supplying tank 2) and a waste liquid treatment device. In addition, FIG. 2 shows the state that the ink jet printing apparatus mounting the printing head unit 1 and the supplying tank 2 for performing a printing is conducted to the home position.

In FIG. 2, reference numeral 3 designates a carriage which is displaced for scanning along a guide shaft 4 by driving means (not shown) while the printing head unit 1 and the supplying tank 2 are mounted thereon. Reference numerals 5 and 6 designate a pair of conveying rollers for conveying a printing sheet P in the A arrow-marked direction, respectively. In the case of this embodiment, inks of yellow (Y), magenta (M), cyan (C) and black (Bk) and treatment liquid (AM) are ejected from the printing head unit 1 during scanning displacement of the carriage 3 along the printing sheet P conducted to the printing position by the conveying rollers 5 and 6.

Reference numerals and characters 2Y, 2M, 2C and 2B designate ink supplying tanks in which four kinds of inks Y, M, C and Bk are received so as to allow them to be supplied to the printing head unit 1. Reference numeral 2AM designates a treatment liquid tank for supplying treatment liquid AM to the printing head unit 1. In addition, reference numeral 7 designates a restoring system unit disposed in the proximity of the home position, reference numeral 8 designates a treatment liquid drain tank, reference numeral 9 designates an ink drain tank, and reference numeral 10 designates a lower case in which the drain tank 8 and 9 are accommodated. The printing head unit 1, the ink supplying tank 2, the restoring system unit 7, the ink drain tank 8 and the treatment liquid tank 9 will be described later in detail.

First, the connected state among the printing head unit 1, the ink supplying tanks 2Y to 2B and the treatment liquid supplying tank 2AM will be described below with reference to FIG. 3.

A liquid absorbing member 12 received in the compressed state while coming in contact with a supplying port 11 of the printing head unit 1 is arranged in each supplying tank 2. Outflow of the liquid in the supplying tank 2 from the latter is prevented by the negative pressure which is generated by a capillary phenomenon appearing in the liquid absorbing member 2. In addition, to prevent an occurrence of incorrect supplying of ink and treatment liquid due to reduction of the liquid in the supplying tank 2 and lowering of inner pressure of the supplying tank 2, an atmosphere communication port 13 is formed at the upper part of the supplying tank 2. Thus, the ink and the treatment liquid in the supplying tank 2 are supplied to the printing head unit 1 by the capillary phenomenon while sponge-like filters 15 filled in an ink supplementing port 14 and a treatment liquid port 14AM formed in the printing head unit 1 are brought in contact with the liquid absorbing member 12 in the supplying tank 2. A supplying port 11 of the supplying tank 2 is closed with an elastic joint seal 16 attached to the printing head unit 1 so that vaporizing of the ink and the treatment liquid is prevented.

Figure 3:
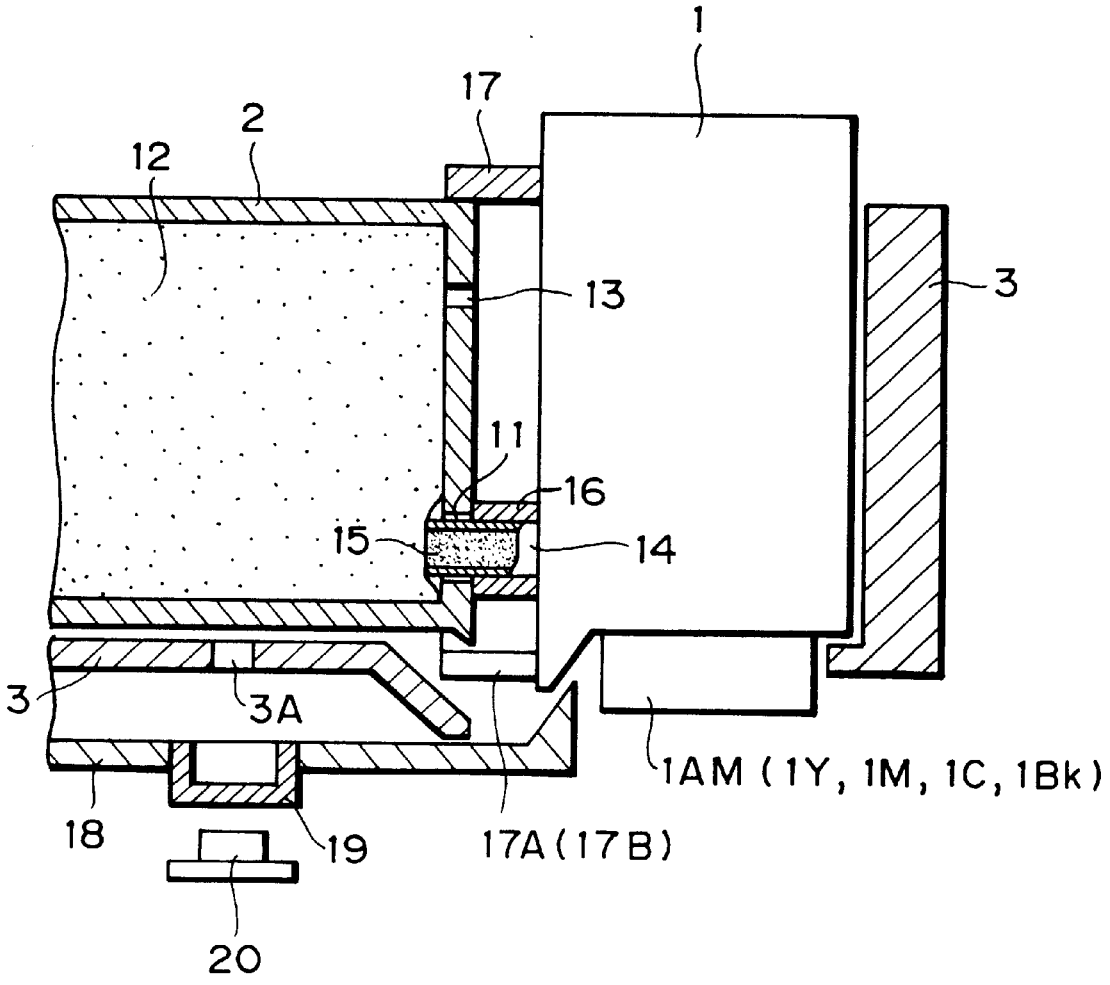
FIG. 3 is a sectional view showing the schematic structure of a connecting portion between a head and a tank according to the first embodiment of the present invention.

In FIG. 3, reference numeral 17 designates a liquid leakage preventing rib which is arranged on the surface of the printing head unit 1 while orienting on the connecting side relative to the supplying tank 2, reference numeral and character 3A designates a liquid detecting hole formed on the bottom of the carriage 3, and 18 is a bracket table which is arranged on the lower surface side of the supplementing port 14 over the whole width of the printing head unit 1. A transparent dish-like container 19 is detachably mounted on the bracket table 18. In addition, reference numeral 20 designates an optical sensor which is disposed below the container 19 to detect the presence or absence of the liquid in the container 19, and moreover, detect the presence or absence of ink or treatment liquid in the supplying tank 2 via the liquid detecting hole 3A. For example, a reflective type photointerrupter can be used for the optical sensor 20.

In addition to the functional description on the respective portions shown in FIG. 3, the structure of the restoring system unit 7 according to this embodiment will be described below with reference to FIG. 1.

In FIG. 1, reference numerals and characters 1Y, 1M, 1C and 1Bkdesignate ink heads for ejecting the four kinds of inks Y, M, C and Bk, and reference numerals and characters 21Y, 21M, 21C and 21Bk designate protection caps for protecting the ink ejecting ports which come in contact with the surfaces of ink ejecting surfaces of the ink heads 1Bk, 1Y, 1M and 1C. Reference numeral and character 21AM designates a protection cap for a treatment liquid head 1AM for ejecting treatment liquid AM. The leakage preventing rib 17 as described above with reference to FIG. 3 includes a partition rib 17H as shown in FIG. 1. The periphery of the treatment liquid supplementing port 14AM and the periphery of the ink supplementing port 14 are separated by the partition rib 17H. As shown in FIG. 1, the bottom of the liquid leakage preventing rib 17 is formed in the funnel-like contour, and a treatment liquid discharging opening portion 17A and an ink discharging opening portion 17B are formed at the bottom of the liquid leakage preventing rib 17. The inks Y, M, C and Bk and the treatment liquid AM leaked from the connecting portion between the printing head unit 1 and the supplying tank 2 are individually sucked from the opening portions 17A and 17B into a treatment liquid groove 22A and an ink receiving groove 22B located below the opening portions 17A and 17B.

Additionally, in FIG. 1, reference numeral and character 23A designates a treatment liquid head restoring suction pump and reference numeral and character 23B designates an ink head restoring suction pump. The protection caps 21Y to 21Bk and 21AM are raised and lowered by cap driving means (not shown). When any printing operation is not performed, the protection caps 21Y to 21Bk and 21AM are brought in contact with the surfaces of the ejecting ports of the ink heads 1Y to 1Bk and the treatment liquid head AM so as to prevent the ink ejecting ports and the treatment liquid ejecting ports from being dried, and moreover, prevent adhesion of dust to the ink ejecting ports and the treatment liquid ejecting ports. When ejecting functions of the ink ejecting ports and the liquid ejecting ports are injured or lost, the restoring suction pumps 23A and 23B are individually driven so that ejecting functions of the heads 1Y to 1B and 1AM can be restored.

In this embodiment, the protection caps 21Y, 21M and 21C are used only for the purpose of protection. However, it is possible that they are constructed such that drain pipes are connected to them so as to enable same restoring to be performed by the ink head storing suction pump 23B.

The receiving grooves 22A and 22B include a treatment liquid receiving portion 24A and an ink receiving portion 24B, a treatment liquid inclined flow passage 25A and an ink inclined flow passage 25B, and a treatment liquid cutout portion 26A and an ink cutout portion 26B disposed on walls between the container 19 and the inclined flow passages 25A and 25B. Details of these portions will be described below later. Reference numeral and character 27A designates a treatment liquid discharging passage for conducting the treatment liquid from the treatment liquid inclined flow passage 25A to the treatment liquid drain tank 8 located below the treatment liquid inclined flow passage 25A, and reference numeral 27B designates an ink discharging passage for conducting ink from the ink inclined flow passage 25B to the ink drain tank 9 located below the ink inclined flow passage 25B.

Figure 4:
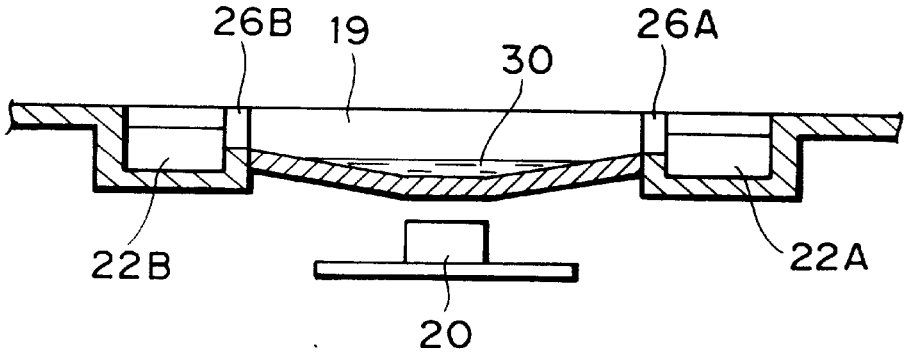
FIG. 4 is a sectional view showing the structure of a leakage detecting device according to the first embodiment of the present invention.
Figure 5:
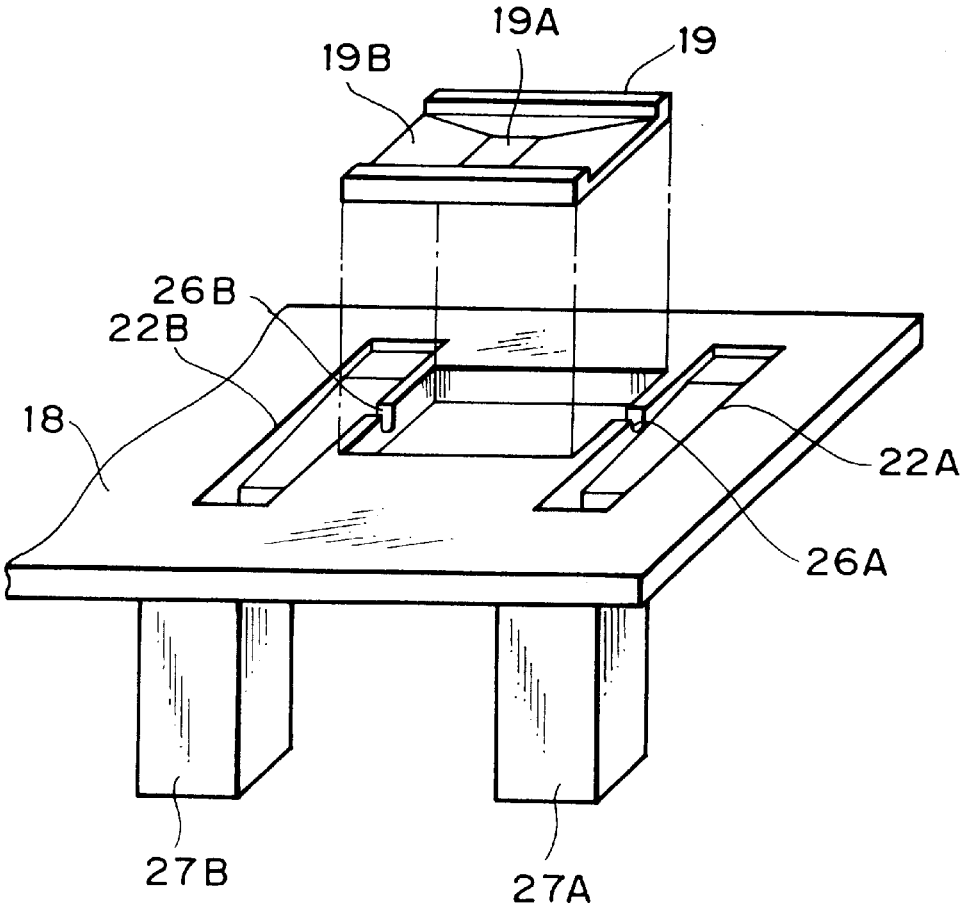
FIG. 5 is a perspective view showing the leakage detecting device in the disassembled state according to the first embodiment of the present invention.

FIG. 4 and FIG. 5 show details of the receiving grooves 22A and 22B and the transparent container 19 arranged on the bracket table 18. In FIG. 4, reference numeral 30 designates treatment liquid and/or ink accumulated in a part of the container 19 extending from a flat portion 19A to an inclined portion 19B of the container 19 (hereinafter referred to as leaked liquid). The present invention is intended to detect the presence or absence of treatment liquid and/or ink in the supplying tank 2, detect an occurrence of leakage, and moreover, treat the leaked liquid by separating it into the treating liquid and the ink. Detecting operation and treating operation in this embodiment will be described below.

A casing of the supplying tank 2 is constructed by a transparent or translucent material. When the presence or absence of ink or treatment liquid in the supplying tank 2 is detected, the supplying tank 2 which is to be detected is conducted to the position located directly above the optical sensor 20 by displacing the carriage 3 in the B arrow-marked direction in FIG. 1 or FIG. 2 (refer to FIG. 3). Thus, the presence or absence of liquid in the supplying tank 2 can be detected via the bottom of the supplying tank 2 having light permeability, the liquid detecting hole 3A formed on the bottom of the carriage 3, and the container 19. Incidentally, the optical sensor 20 makes it possible to detect a quantity of liquid remaining in the supplying tank 2 via variation of a quantity of light by irradiating light upwardly from a light emitting portion (not shown) of, e.g., a photointerrupter and reading the presence or absence of reflected light with a light receiving portion (not shown) of the photointerrupter. In addition; the leakage of the liquid can individually be detected with the treatment liquid tank 2AM and the ink supplying tanks 2Y to 2Bk in such a manner as described later. Such detecting operation is performed, e.g., directly after a power source is turned on and by a predetermined quantity of printing performed for the printing sheet P.

Figure 6:
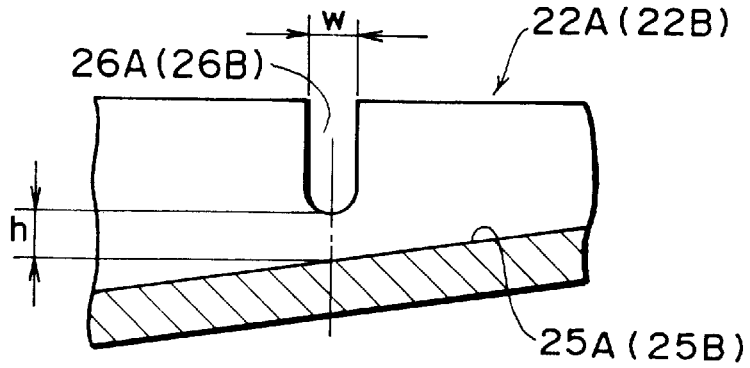
FIG. 6 is an enlarged partial sectional view showing together with FIG. 7 and FIG. 8 main portions of leaked ink conducting means and leaked treatment liquid conducting means in the state that no leakage occurs according to the first embodiment of the present invention.
Figure 7:
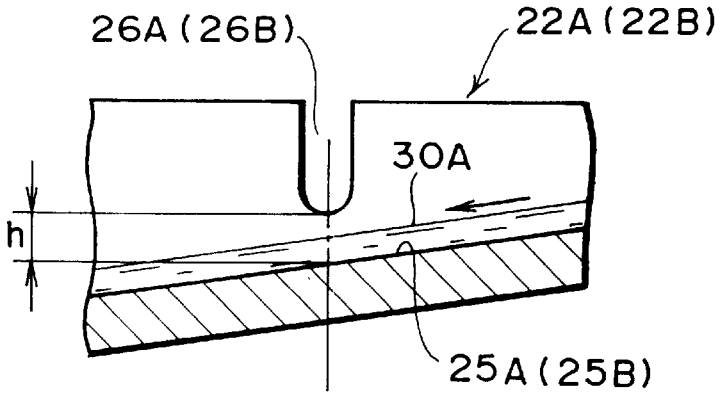
FIG. 7 is an enlarged partial sectional view showing together with FIG. 6 and FIG. 8 the main portions of the leaked ink conducting means and the leaked treatment means in the state that a small quantity of leakage occurs according to the first embodiment of the present invention.
Figure 8:
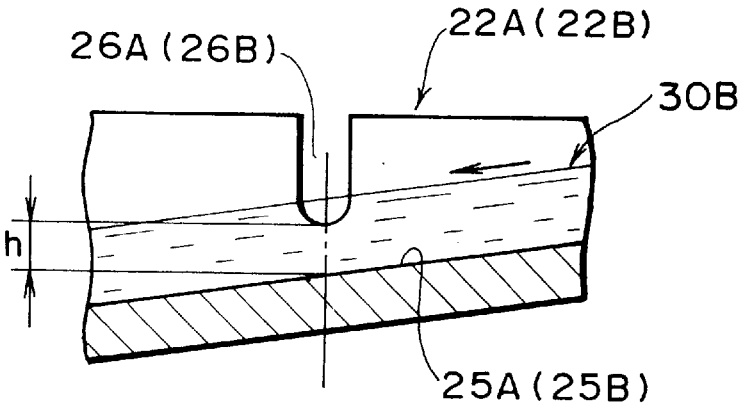
FIG. 8 is an enlarged partial sectional view showing together with FIG. 6 and FIG. 7 main portions of the leaked ink conducting means and the leaked treatment means in the state that a large quantity of leakage occurs according to the first embodiment of the present invention.

Next, operations for detecting leakage of the treatment liquid AM and the inks Y, M, C, and Bk will be described below with reference to FIG. 6 to FIG. 8. According to the present invention, detecting operation and treating operation are performed separately for a small quantity of leakage and a large quantity of leakage.

In the case that liquid leakage occurs, possible leakage of the liquid is caused from the vicinity of the supplying tank 2, i.e., from the supplying port 11 and the atmosphere communicating port 13. In the case that a small quantity of leakage occurs, an upper surface 30A of the leaked liquid is not elevated in excess of a height h as measured from the upper surface of the inclined portion 19B of the container 19 to the bottom of the cutout 26A or 26B as shown in FIG. 7. Therefore, in the case of the treatment liquid AM, the leaked liquid 30 held in the state of a small quantity of leakage is conducted directly to the treatment liquid drain tank 8 from the treatment liquid inclined flow passage 25A of the treatment liquid receiving groove 22A so as to allow the leaked liquid 30 to be received in the treatment liquid drain tank 8. In the case of the inks Y, M, C and Bk, the leaked liquid 30 is conducted directly to the ink drain tank 9 from the ink inclined flow passage 25B. In either case, the liquid does not flow in the container 19.

Provided that the treatment liquid AM and one or plural inks Y, M, C and Bk simultaneously leak, the treatment liquid and the ink are conducted from the different receiving grooves 22A and 22B to the drain tanks 8 and 9. For this reason, there does not arise an occasion that the treatment liquid and the ink mix with each other and they are solidified at the intermediate part of each printing operation. Additionally, the interior or the exterior of the printing apparatus is not contaminated with the liquid due to overflow of the liquid. It should be noted that the treatment liquid AM leaked from the periphery of the treatment liquid supplying port 11 of the treatment liquid supplying tank 2AM as well as the atmosphere communicating port 13 is collected at the treatment liquid discharging opening portion 17A formed on the leakage preventing rib 17. The inks likewise leaked from the ink supplying tanks 2Y, 2M, 2C and 2Bk are collected at the ink discharging opening portion 17B and separately flow down in the leakage treatment liquid receiving portion 24A of the receiving groove 22A and the leaked ink receiving portion 24B of the ink receiving groove 22B located below the ink supplying tanks 2Y, 2M, 2C and 2Bk.

Next, the case that a large quantity of liquid leakage occurs will be described below.

As mentioned above, the height h from the upper surfaces of the inclined flow passages 25A and 25B of the cutout portions 25A and 25B is determined in consideration of a width w of each inclined flow passage, viscosity of the liquid and so forth. As shown in FIG. 7, in the case that a small quantity of leakage occurs, the upper surface 30A of leaked liquid does not reach the height of the cutout portions 26A and 26B, and the leaked liquid flows down as it is until it is absorbed and received in the absorbing members (not shown) of the drain tanks 8 and 9. As shown in FIG. 8, in the case that a large quantity of liquid leakage occurs, an upper surface 30B of the leaked liquid is elevated in excess of the height h of the cutout portions 26A and 26B and the leaked liquid overflows in a flat portion 19A of the container 19 (refer to FIG. 4 and FIG. 5). The foregoing state is detected by the optical sensor, i.e., the reflection type photointerrupter 20 since light penetration is obstructed by the photointerrupter 20. Then, an adequate measure is taken as described later so as to deal with a problem that a large quantity of liquid leakage occurs with the result that a correct printing operation fails to be performed. In the case that a large quantity of leakage occurs with both of the treatment liquid AM and inks Y, M, C and Bk, solidification of the inks takes place on the container 19. In such case, since the container 19 is detachably constructed, it suffices that the container 19 is exchanged with new one. In the case that a large quantity of leakage occurs with either one of the treatment liquid AM and the inks Y, M, C and Bk, it is recommended that, for example, the container 19 is disconnected from the bracket table 18, it is wiped with a clean cloth, and thereafter, it is reused.

Figure 9:
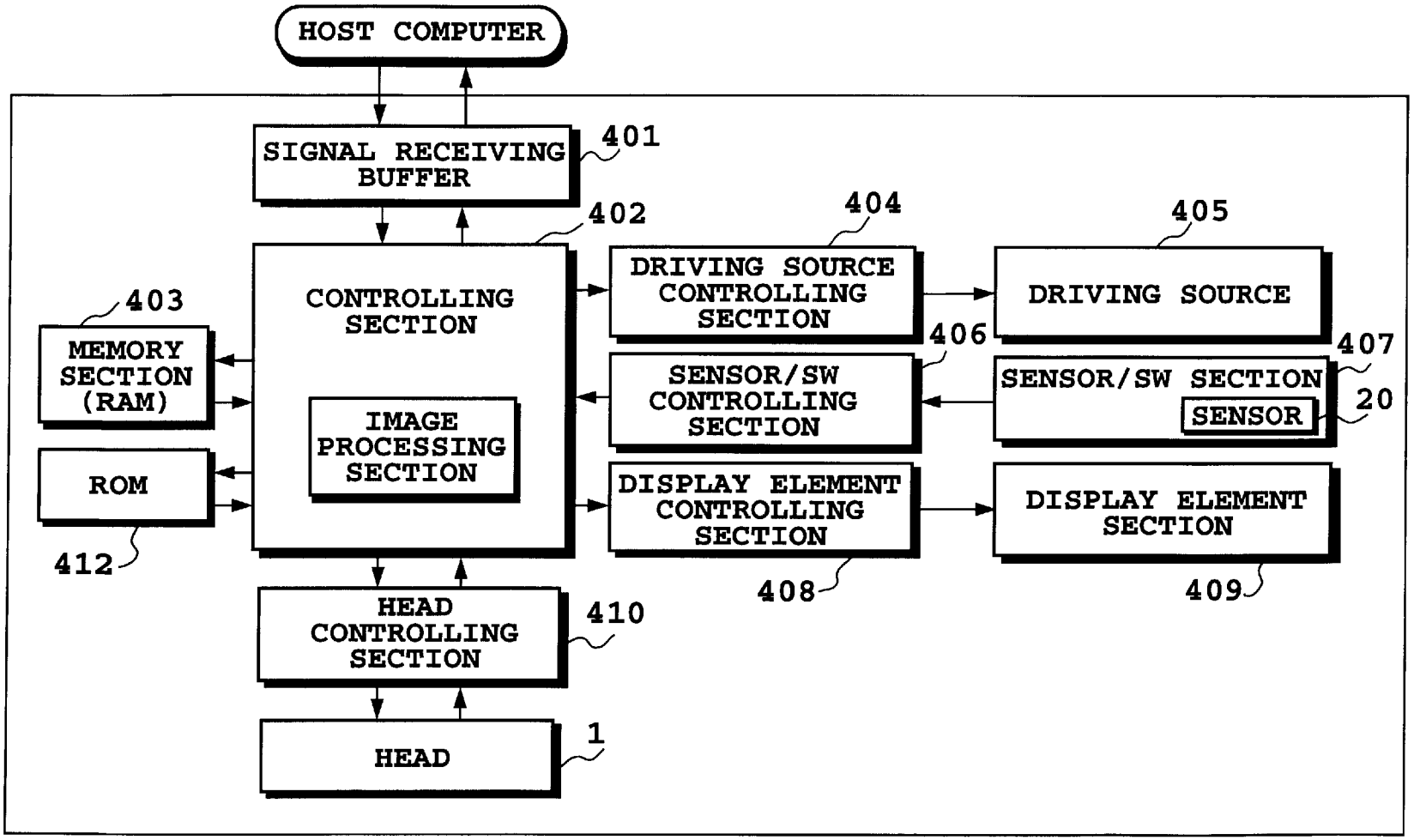
FIG. 9 is a block diagram showing the structure of a controlling circuit according to the present invention.

FIG. 9 is a block diagram which shows a circuit structure which makes it possible that a printing operation is performed, various kinds of detection inclusive of detection of a large quantity of liquid leakage are performed, and a controlling operation is performed based on the results of detection. Data of characters and images to be printed (hereinafter referred to as image data) are inputted from a host computer to a signal receiving buffer 401 of the printing apparatus. Data for confirming whether they are correctly transmitted or not and data for informing the operative state of the printing apparatus are transmitted from the printing apparatus to the host computer. The data inputted in the signal receiving buffer 401 are transmitted to a memory section 403 in the form of RAM under control of a controlling section 402, and they are temporally stored in the memory section 403. In response to a command from the controlling section 402, a driving source controlling section 404 drives a driving source 405 such as a carriage motor, a line feed motor or the like each serving as a power source for the pairs of conveying rollers 5 and 6. A sensor/SW controlling section 406 transmits to the controlling section 404 signals from a sensor/SW section 407 including various kinds of sensors and switches. In response to a command from the controlling section 402, a display element controlling section 408 controls the display of a display element section 409 including LED of a group of display panels, liquid crystal displaying elements or the like. In response to a command from the controlling section 402, a head controlling section 410 individually controls the respective heads 1Y to 1Bk and 1AM. In addition, the head controlling section 410 reads the temperature information or the like showing the operative state of the heads 1Y to 1B and 1AM and then transmits these information to the controlling section 402.

Reference numeral 411 designates ROM in which programs associate with various kinds of controlling are stored. Also a controlling operation associated with detection of the presence or absence of the treatment liquid and the inks is performed by the controlling section 402 in conformity with the program stored in the ROM 411. In addition, for example, when a large quantity of liquid leakage occurs, a message for informing a large quantity of liquid leakage can be outputted from the display element section 409.

The optical sensor 20 mentioned above in the foregoing embodiment is included in the sensor/SW section 407. When a large quantity of liquid leakage is detected by the optical sensor 20, the controlling section 402 outputs to the display element section 409 a message for warning an occurrence of liquid leakage via the display element controlling section 408. Although any illustration is not shown in the block diagram, it is possible to construct the controlling circuits so as to simultaneously output an alarm or warning via sound.

Figure 10:
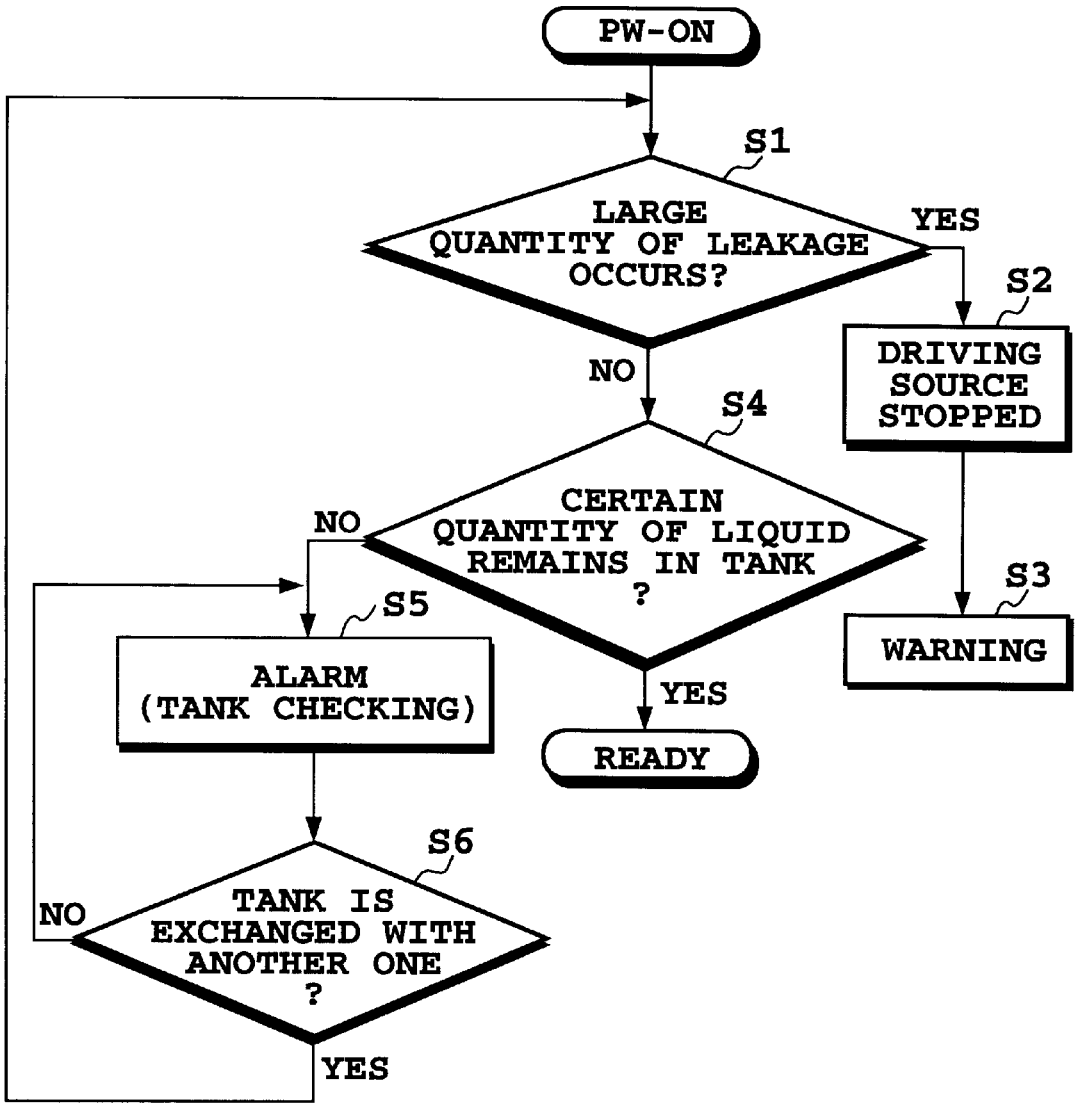
FIG. 10 is a flowchart showing the procedure of leakage detecting operations to be performed according to the present invention.

FIG. 10 is a flowchart which shows a procedure of detecting operations for detecting the presence or absence of treatment liquid and inks in the supplying tank 2 performed, e.g., when power source is turned on, and detecting an occurrence of liquid leakage. When power source is turned on, the presence or absence of a large quantity of liquid leakage is detected at Step S1 by the optical sensor 20 as mentioned above. In the case that an occurrence of a large quantity of liquid leakage is detected, the program goes to Step S2 at which a function of driving source 405 is stopped via the driving source controlling section 404. Further, the program goes to Step S3 at which it is required to take a measure for dealing with the problem of a large quantity of liquid leakage by issuing an alarm or warning, e.g., a message from the display element section 409. In the case that determination is made at Step S1 such that a large quantity of liquid leakage does not occur, the carriage 3 is driven as mentioned above, and the program goes to Step S4 at which the presence or absence of the treatment liquid and inks is detected by the optical sensor 20 with respect to each supplying tank 2. In the case that it is determined that the treatment liquid AM is present in the treatment liquid supplying tank 2AM and the inks Y to Bk are present in the ink supplying tanks 2Y to 2Bk, the program goes to a standby state at which a printing operation can be performed. On completion of the printing operation, treatment is terminated.

In the case that the absence of any one of the treatment liquid AM and the inks Y to Bk is detected at Step S4, the program goes to Step S5 at which information is given as to which supplying tank becomes empty or an alarm or warning is issued so as to inform that the supplying tank 2 becomes empty. When the supplying tank 2 is exchanged or replaced with a new one at Step S6, the program returns to Step S1 so that the aforementioned steps are repeated.

In the case that the printing apparatus is used as a network via the host computer in the foregoing embodiment, it is recommended that an error message is displayed on the displaying section of a terminal unit used by a user via a printer driver (not shown). By giving information in the aforementioned manner, it becomes possible that a care is taken by the user so as not to incline the printing apparatus or a cleaning operation is performed. In addition, contamination of the interior of the printing apparatus with the leaked liquid can be suppressed to a minimum limit, and leakage of the liquid from the printing apparatus can be prevented.

In this embodiment, when a small quantity of leakage occurs with inks and treatment liquid in the printing apparatus for performing a printing with the use of inks and treatment liquid usable to control printing properties of the inks, the leaked liquid and/or inks are separately conducted to the existent treatment liquid drain tank 8 and the existent ink drain tank 9 for the purpose of conducting them. When a large quantity of leakage occurs, this fact of leakage is informed to a user. At this time, the transparent container 19 is detachably constructed. Thus, a printing apparatus having high image quality and high reliability and exhibiting excellent maintenance performances can be obtained.

Figure 11:
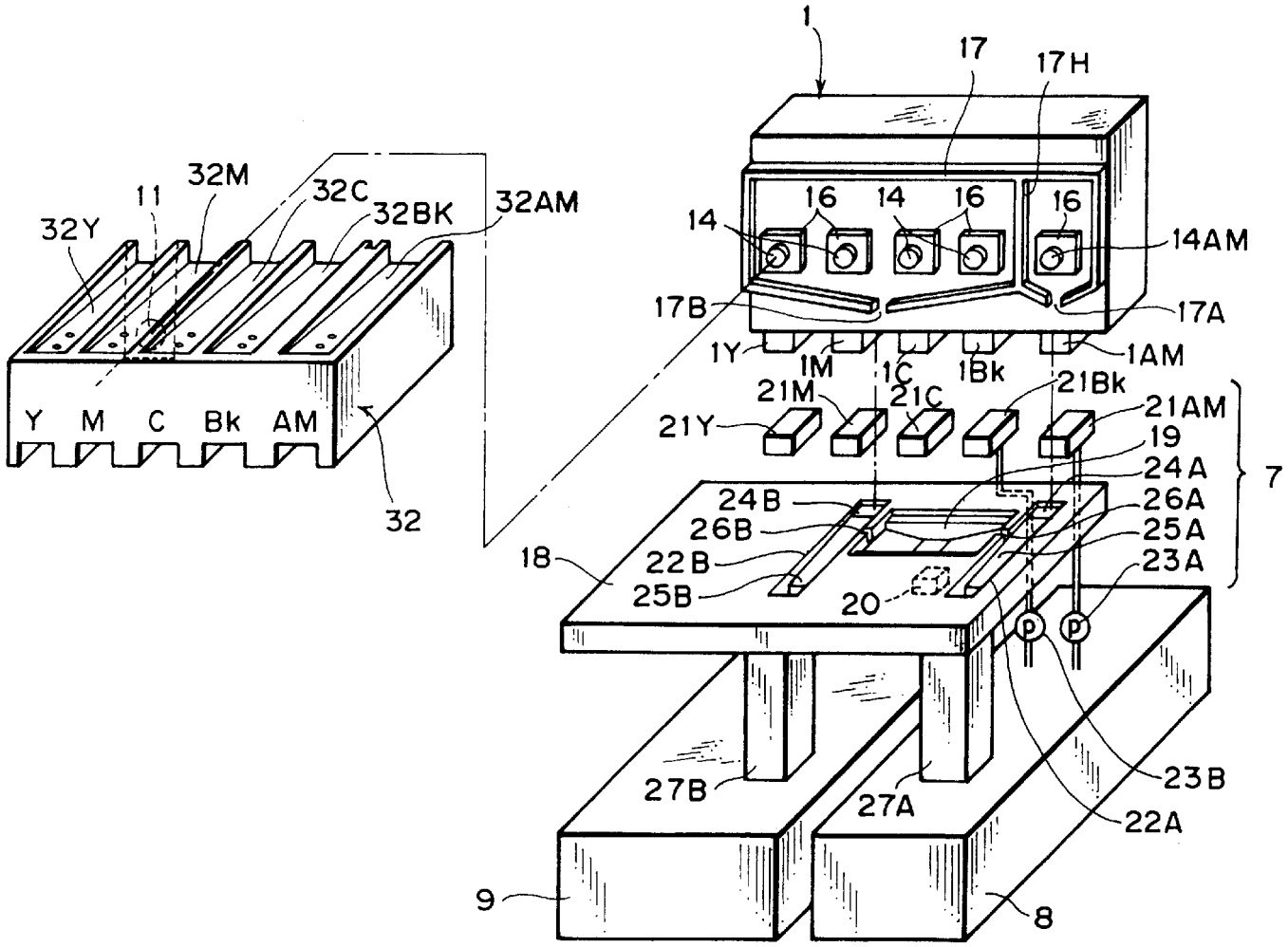
FIG. 11 is a perspective view showing together with FIG. 12 the schematic structure of main components of an ink jet printing apparatus according to a second embodiment of the present invention.
Figure 12:
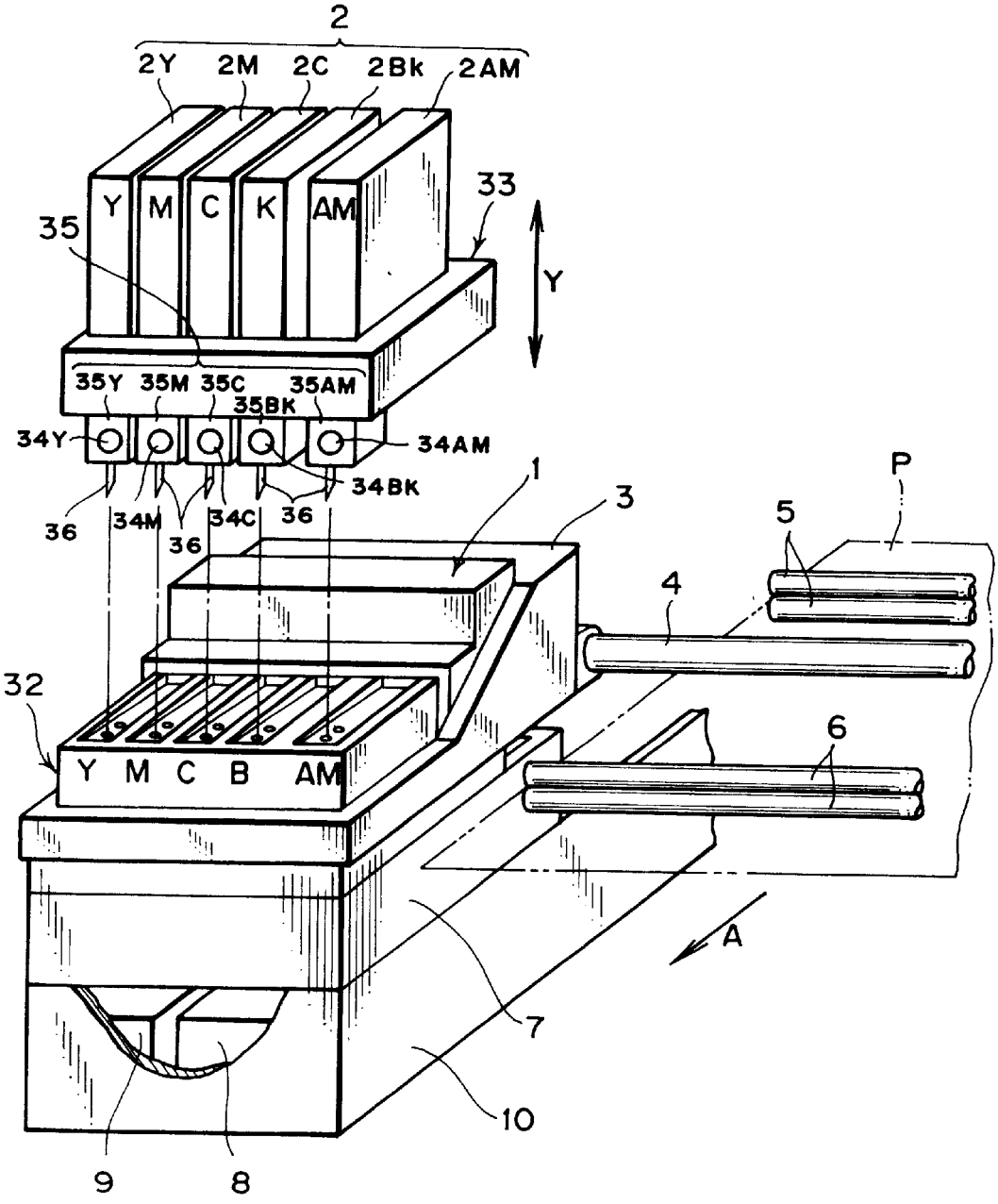
FIG. 12 is a perspective view showing together with FIG. 11 the schematic structure of the main components of the printing apparatus in the exploded state according to the second embodiment of the present invention.

FIG. 11 and FIG. 12 show the structure of an ink jet recording apparatus according to a second embodiment of the present invention. Members and sections having the same function as those in the first embodiment are represented by same reference numerals and characters, and repeated description on them is eliminated for the purpose of simplification.

This embodiment is applied to a printing apparatus for performing a printing with supplying tanks mounted on a carriage 3 together with a printing head unit 1, and in this embodiment, the weight of members mounted on the carriage 3 is reduced by suppressing a quantity of liquid in supplying tanks mounted on the carriage 3 so that the carriage 3 can be displaced at a high speed for assuring a high speed printing operation.

In FIG. 11 and FIG. 12, reference numeral 32 designates a supplying tank unit which is connected to the printing head unit 1. The supplying tank unit 32 serves to supply treatment liquid and inks to the printing head unit 1 while it is mounted on the carriage 3 together with the printing head unit 1 as shown in FIG. 12. On the other hand, as shown in FIG. 12, supplying tanks 2 inclusive of a treatment liquid supplying tank 2AM (hereinafter referred to as supplementing tank in this embodiment) are held on a supplementing tank holder 33 which can vertically be displaced in the Y arrow-marked direction in FIG. 12. Liquid supplying portions 35Y, 35M, 35C, 35Bk and 35AM (hereinafter represented simply by 35) including opening/closing valves 34Y, 34M, 34C, 34Bk and 34AM separately for supplementing tanks 2Y to 2B and 2AM are arranged on the supplementing tank holder 33.

Although not shown in the drawings, the supplying tank unit 32 are separatively divided into a receiving portion for receiving inks Y, M, C and Bk and a receiving portion for receiving treatment liquid AM by a partition plate. Reference numeral 36 designates a hollow supplementing needle which serves to supplement ink and treatment liquid from the supplementing tank 2 to the receiving portion located below the supplementing tank 2 corresponding to the supplying tank unit 32.

Figure 13:
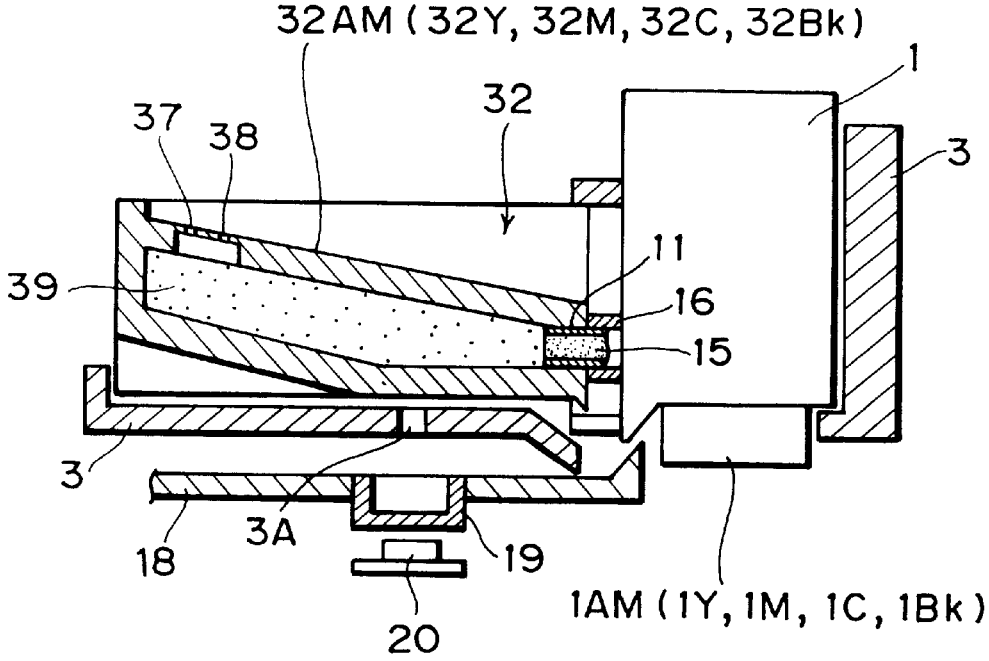
FIG. 13 is a sectional view showing a connecting portion between a head and a tank according to the second embodiment of the present invention.

FIG. 13 is a sectional view which shows the connecting state between the supplying tank unit 32 and the printing head unit 1. As shown in the drawing, the supplying tank unit 32 is intended to reduce its weight by allowing the respective receiving portions to receive the treatment liquid AM and the inks Y, M, C, and Bk by a quantity of minimum limit without any trouble for each printing operation. A casing of the supplying ink unit 32 is integrally constructed by using a transparent or translucent material, and inclined grooves 32Y, 32M, 32C, 32Bk and 32AM each having a downward gradient toward the printing head unit 1 side are formed on the upper surface of each receiving portion. Reference numeral 37 designates a supplementing port which is formed in the vicinity of the uppermost end of each of the inclined grooves 32Y to 32Bk and 32AM, and reference numeral 38 designates an atmosphere communicating port which is formed adjacent to the supplementing port 37 in the vicinity of the uppermost end of each of the inclined grooves 32Y to 32Bk and 32AM. A porous liquid absorbing member 39 is filled in each receiving portion for holding treatment liquid and inks to be supplied to the printing head unit 1 at the negative pressure.

Figure 14:
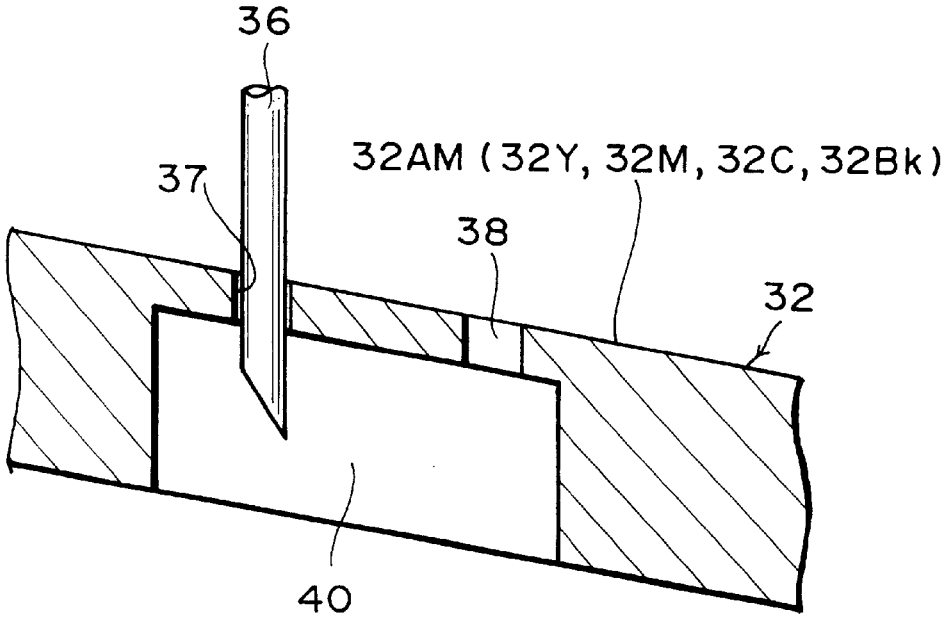
FIG. 14 is an enlarged partial sectional view showing the supplementing port of a first supplying tank according to the second embodiment of the present invention.

FIG. 14 is an enlarged sectional view which shows the state that the hollow supplementing needle 36 located on the supplementing tank holder 33 side is inserted into the interior of the supplying tank unit 32 from the supplementing port 37 when the treatment liquid and/or the inks are supplemented. Reference numeral 40 designates a gap portion which is formed so that the treatment liquid and the inks do not leak from the supplementing port 37 and the atmosphere communicating port 38 as far as possible.

Figure 15:
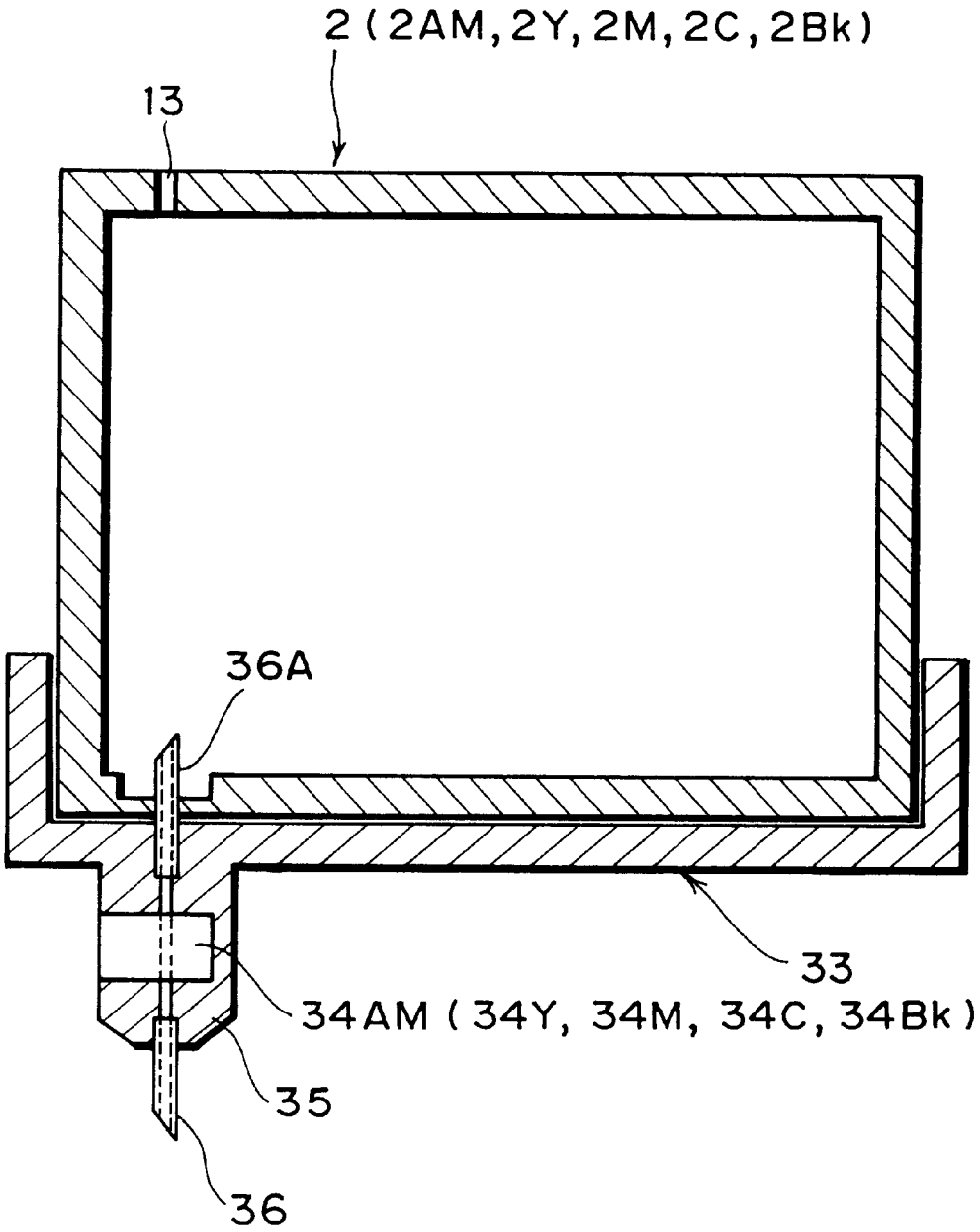
FIG. 15 is a sectional view showing the structure of a second supplying tank according to the second embodiment of the present invention.
Figure 16:
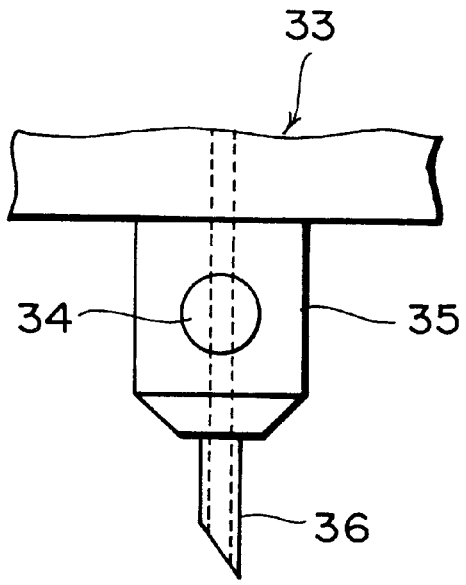
FIG. 16 is an enlarged partial view showing together with FIG. 17 a part of a liquid supplementing opening/closing valve for the second supplying tank in the opened state according to the second embodiment of the present invention.
Figure 17:
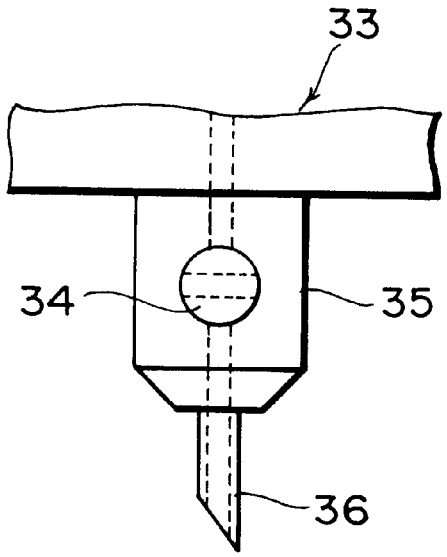
FIG. 17 is an enlarged partial view showing together with FIG. 16 a part of the liquid supplementing opening/closing valve for the second supplying tank in the closed state according to the second embodiment of the present invention.

The attached state of the supplementing tank 2 to the supplementing holder 33 will be described below with reference to FIG. 15. The supplementing tanks 2Y, 2M, 2C, 2Bk and 2AM are detachably held on the supplementing tank holder 33, and in this embodiment, treatment liquid AM and inks Y to Bk are received in the supplementing tank 2. FIG. 15 is a sectional view which shows the state that the supplementing tank 2 is molded of an elastic material such as rubber or the like and the hollow supplying needle 36A is pierced through a plug member for sealing the ink supplying port.

Although not shown in the drawing, a wall for partitioning at least the treatment liquid supplying tank 2AM and other ink supplying tanks 2Y to 2Bk is arranged on the supplementing tank holder 33. With this construction, consideration is taken such that the treatment liquid AM and the inks Y, M, C and Bk do not mix with each other even though they leak in the supplementing tank holder 33. The structure for attaching the supplementing tank 2 to the supplementing tank holder 33 should not be limited to the structure as mentioned above.

In this embodiment, when a usual printing operation is performed with the aforementioned structure, the supplementing tank holder 33 is driven by driving means (not shown) so that it is elevated to an escape position corresponding to the home position to assume the state that the supplementing tank 2 is separated from the supplying tank unit 32. As the treatment liquid 2AM and the inks Y, M, C and Bk are supplied from the supplying tank unit 32 to the treatment liquid head 1AM and the ink heads 1Y to 1Bk during scanning of the carriage 3, a printing operation is performed. When a quantity of treatment liquid and/or inks is substantially reduced, this state is detected by the optical sensor 20 as shown in FIG. 11 in such a manner as mentioned above with respect to the first embodiment of the present invention. After the carriage 3 is displaced to the home position as shown in FIG. 12, the supplementing tank holder 33 is lowered to the supplementing position, the hollow supplementing needle 36 is inserted into a supplementing port 37 of the supplying tank unit 32, and moreover, the opening/closing valve 34 is turned by driving means (not shown) from the state shown in FIG. 17 to the state shown in FIG. 16 so that inks and/or treatment liquid are supplemented from the supplementing tank 2. On completion of the supplementing operation, the opening/closing valve 34 returns again to the state shown in FIG. 17, and additionally, the supplementing tank holder 33 is elevated to the escape position so that a series of supplementing operations are completed.

It should be noted that five opening/closing valves 34 corresponding to the respective supplementing tanks 2 can be driven independently. Therefore, an adequate quantity of ink and treatment liquid necessary for performing each printing operation is always retained in the receiving portion in the supplying tank unit 32 by performing a series of supplementing operations as desired.

In this embodiment, treatment liquid and inks are supplemented from the supplementing tank 2 to the supplying tank 32, and the treatment liquid and inks are supplied from the supplying tank unit 32 to the printing head unit 1. Therefore, as is apparent from FIG. 13, provided that treatment liquid and inks leak, it may be considered that leakage occurs from the periphery of the supplementing port 37 of the supplying tank unit 32 and the periphery of the supplying port 11.

Also in the case of this embodiment, a measure can separately be taken to deal with a small quantity of leakage as well as a large quantity of leakage. Different points of the second embodiment from the first embodiment consist in that what kind of measure is taken to deal with the leakage from the periphery of the supplementing port 37 of the supplying tank unit 32 and the opening/closing valves 34AM and 34Y to 34Bk. In this embodiment, since inclined grooves 32Y to 32Bk and 32AM are formed on the upper surface of the supplying tank unit 32 for separately dealing with the leakage of the treatment liquid and the leakage of the ink, leaked ink and/or leaked treatment liquid are separately conducted to liquid receiving grooves 22A and 22B associated with the inclined grooves 32Y to 32Bk and 32AM even though a small quantity or a large quantity of leakage occurs around the periphery of the supplementing port 37 and the opening/closing valve 34. Thereafter, a measure can be taken to deal with a small quantity of liquid leakage or a large quantity of liquid leakage in the same manner as described above in the first embodiment of the present invention.

Since it becomes possible that the total weight of the carriage 3 is reduced and the carriage 3 is displaced at a high speed by employing the structure mentioned above with respect to this embodiment, an advantage of the present invention is that a printing operation can be performed at a high speed. In addition, since a load to be borne by a carriage motor for driving the carriage 3 is reduced, the carriage motor can be constructed with small dimensions at a lower cost. Additionally, since the limitation with respect to the capacity of the supplementing tank 2 disappears, other advantage of the present invention is that printing operations can be performed for a number of printing papers by single replacement or exchange of the supplementing tank 2 with a new one.

Further, since leaked ink and/or leaked treatment liquid are absorbed in liquid absorbing members in the drain tanks 8 and 9 when leakage of the ink and/or treatment liquid leak occurs, malfunctions of contamination of the interior of the printing apparatus with the leaked liquid and outflow of the leaked liquid from the printing apparatus can be prevented even in the case that the printing apparatus is inclined. Consequently, each printing operation can be performed with a high quality of printed image, and moreover, properties of each maintenance service to be achieved for the printing apparatus can be improved.

Also in this embodiment, it becomes possible that a care is taken by a user so as not to allow the printing apparatus to be inclined and a necessity for cleaning operations is recognized by the user by providing the printing apparatus with large quantity leakage detecting means and warning means similar to those in the first embodiment of the present invention. Thus, contamination of the printing apparatus with leaked liquid can be minimized, and outflow of the leaked liquid from the printing apparatus can be prevented.

In addition, even though a manner of supplying ink and treatment liquid to the printing apparatus in the first embodiment is different from that in the second embodiment, the present invention can be applied to the printing apparatus. For example, with respect to a printing apparatus of the type in which supplying of ink and treatment liquid to a printing head is achieved from a supplementing tank arranged on the main body side via tubes extending from the supplementing tank, the same advantages similar to those in the foregoing embodiment can be obtained by arranging independent leaked liquid receiving means below the tubes and inclining the leaked liquid receiving means for displacing the leaked liquid to a treatment liquid drain tank and an ink drain tank arranged on the main body side.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus comprising:

a carriage that carries at least a first and a second ink jet head and a first and a second printing liquid storing tank for storing printing liquid which is supplied to each of said first and, second ink jet heads, said printing liquid storing tanks being detachably attached to connecting portions of said first and second ink jet heads, respectively;

a first and a second liquid collecting tank for collecting printing liquid leaked during an attaching/detaching operation or leaked from said connecting portions of said first and second ink jet heads, said first liquid collecting tank being separate from said second liquid collecting tank;

a first and a second liquid conducting passage for connecting said connecting portions of said first and second ink jet heads with said first and second liquid collecting tanks, respectively, said first liquid conducting passage being separate from said second liquid conducting passage;

a partition member interposed between the connecting portions of said first and second ink jet heads, to which said first and second printing liquid storing tanks are attached, respectively, for preventing the liquid leaked from one of the connection portions of said ink jet heads in attaching/detaching said printing liquid storing tank from reaching the other adjacent connecting portion of said ink jet head and guiding the leaked liquid to said liquid conducting passage; and a table disposed beneath said carriage at a home position, said table being provided with a first recess and a second recess for respectively receiving first liquid and second liquid guided by said partition member, said first and second recesses being connected with said first and second liquid conducting passages, respectively.

2. The ink jet printing apparatus as claimed in claim 1, wherein said first printing liquid storing tank stores liquid containing a colorant and said second printing liquid storing tank stores a treatment liquid, by which printing properties are controllable.

3. A printing apparatus as claimed in claim 2, wherein an additional ink supplying tank is connected to said first printing liquid storing tank, said additional ink, supplying tank having an ink supplying port formed thereon, and said additional ink supplying tank being displaceable to a supplementing position where ink is supplemented to said first printing liquid storing tank and a standby position where no ink is supplemented, and wherein an additional treatment liquid supplying tank is connected to said second printing liquid storing tank, said additional treatment liquid supplying tank having a treatment liquid supplying port formed thereon, and said additional treatment liquid supplying tank being displaceable to a supplementing position where treatment liquid is supplemented to said second printing liquid storing tank and a waiting position where no treatment liquid is supplemented.

4. A printing apparatus as claimed in claim 1, further comprising first recording liquid sucking means for sucking the first recording liquid, and second recording liquid sucking means for sucking the second recording liquid.

5. A printing apparatus as claimed in claim 1, wherein said first recording liquid supplying tank can receive plural kinds of color first recording liquids, and said first recording liquid head can perform a color printing by ejecting plural kinds of color first recording liquids.

6. A printing apparatus as claimed in claim 1, wherein a plurality of ejecting energy generating portions each serving to eject the first recording liquid are arranged on said first recording liquid head, and that a plurality of ejecting energy generating portions each serving to eject the second recording liquid are arranged on said second recording liquid head, and wherein each of said ejecting energy generating portions includes an electrothermal transducer for generating thermal energy so as to cause film boiling.

7. An ink jet printing apparatus comprising:

a carriage that carries at least a first and a second ink jet head and a first and a second printing liquid storing tank for storing printing liquid which is supplied to each of said first and second ink jet heads, said printing liquid storing tanks being detachably attached to connecting portions of said first and second ink jet heads, respectively;

a first and a second liquid collecting tank for collecting printing liquid leaked during an attaching/detaching operation or leaked from said connecting portions of said first and second ink jet heads, said first liquid collecting tank being separate from said second liquid collecting tank;

a first and a second liquid conducting passage for connecting said connecting portions of said first and second ink jet heads with said first and second liquid collecting tanks, respectively, said first liquid conducting passage being separate from said second liquid conducting passage;

a partition member interposed between the connecting portions of said first and second ink jet heads, to which said first and second printing liquid storing tanks are attached, respectively, for preventing the liquid leaked from one of the connection portions of said ink jet heads in attaching/detaching said printing liquid storing tank from reaching the other adjacent connecting portion of said ink jet head and guiding the leaked liquid to said liquid collecting passage;

a table disposed beneath said carriage at a home position, said table being provided with a first recess and a second recess for respectively receiving first liquid and second liquid guided by said partition member, said first and second recesses being connected with said first and second liquid conducting passages, respectively;

an optical sensor for detecting the leaked first and second liquids, said optical sensor being arranged at the position associated with said first and second liquid conducting passages;

a transparent container to which at least a part of the first liquid conducted in said first liquid conducting passage and at least a part of the second liquid conducted in said second liquid conducting passage are conducted, wherein said optical sensor detects the first and second liquids conducted to said container, wherein said first liquid conducting passage includes an inclined flow passage for conducting the leaked first liquid to said first liquid collecting tank, and said second liquid conducting passage includes an inclined flow passage for conducting the leaked second liquid to said second liquid collecting tank; and wherein a pair of cutout portions are formed at intermediate positions of said inclined flow passages for conducting respectively to said container the first and second liquids leaked in excess of a predetermined flow rate.

8. A printing apparatus as claimed in claim 7, wherein said optical sensor is a reflective type photointerrupter.

9. A printing apparatus as claimed in claim 7, wherein said transparent container is detachably mounted in the apparatus.

10. A printing apparatus as claimed in claim 7, wherein a presence or an absence of the first recording liquid in said first recording liquid supplying tank and the second recording liquid in said second recording liquid supplying tank is detected by said leakage detecting means.

11. A printing apparatus as claimed in claim 7, wherein said printing apparatus further includes informing means for informing a result of detection performed by said optical sensor.

12. A printing apparatus as claimed in claim 11, wherein said informing means includes at least one of displaying mean and alarm generating means.

13. An ink jet printing apparatus comprising:

a first ink jet head for ejecting ink which contains a colorant and a second ink jet head for ejecting treatment liquid so as to control printing properties, the treatment liquid containing no colorant;

a carriage that carries an ink storing tank for storing ink which is used to be supplied to said first ink jet head in printing and a treatment liquid storing tank for storing treatment liquid which is used to be supplied to said second ink jet head in printing, said ink storing tank being detachably attached to said first ink jet head, said treatment liquid storing tank being detachable attached to said second ink jet head, said carriage for scanning said first and second ink jet heads;

a table having a first recess for receiving an amount of leaked ink which has leaked from a first connecting portion between said first ink jet head and said ink storing tank, and a second recess for receiving an amount of leaked treatment liquid which has leaked from a second connecting portion between said second ink jet head and said treatment liquid storing tank, said table being disposed below said carriage at a home position of said carriage;

a third recess for receiving the amount of leaked ink and amount of leaked treatment liquid which overflow from said first and second recess, said third recess consisting of transparent materials provided in said table;

a sensor for, sensing a presence or an absence of the amount of leaked ink and the amount of leaked treatment liquid which has overflowed into said third recess;

controlling means for apprising a sensing information by said sensor and for stopping a printing operation; and a first drain passage being connected to said first recess of said table and a second drain passage being connected to said second recess of said table.

14. An ink jet printing apparatus comprising:

a first ink jet head for ejecting ink which contains a colorant and a second ink jet head for ejecting treatment liquid so as to control printing properties, the treatment liquid containing no colorant;

a carriage that carries an ink storing tank for storing ink which is used to be supplied to said first ink jet head in printing and a treatment liquid storing tank for storing treatment liquid which is used to be supplied to said second ink jet head in printing, said ink storing tank being detachably attached to said first ink jet head, said treatment liquid storing tank being detachably attached to said second ink jet head, said carriage for scanning said first and second ink jet heads;

a table having a first recess for receiving an amount of leaked ink which has leaked from a first connecting portion between said first ink jet head and said ink storing tank, and a second recess for receiving an amount of leaked treatment liquid which has leaked from a second connecting portion between said second ink jet head and said treatment liquid storing tank, said table being disposed below said carriage at a home position of said carriage;

a third recess for receiving the amount of leaked ink and the amount of leaked treatment liquid which overflow from said first and second recesses, said third recess consisting of transparent materials provided in said table;

a sensor for sensing a presence or an absence of the amount of leaked ink and the amount of leaked treatment liquid which has overflowed into said third recess;

controlling means for apprising a sensing information by said sensor and for stopping a printing operation; and a first drain passage being connected to said first recess of said table and a second drain passage being connected to said second recess of said table, wherein the presence or absence of the amount of leaked ink and the amount of leaked treatment liquid is sensed by utilizing at least one of visual checking means and auditory checking means.

15. An ink jet printing apparatus comprising:

a first ink jet head for ejecting ink which contains a colorant and a second ink jet head for ejecting treatment liquid so as to control printing properties, the treatment liquid containing no colorant;

a carriage that carries an ink storing tank for storing ink which is used to be supplied to said first ink jet head in printing and a treatment liquid storing tank for storing treatment liquid which is used to be supplied to said second ink jet head in printing, said ink storing tank being detachably attached to said first ink jet head, said treatment liquid storing tank being detachably attached to said second ink jet head, said carriage for scanning said first and second ink jet heads;

a table having a first recess for receiving an amount of leaked ink which has leaked from a first connecting portion between said first ink jet head and said ink storing tank, and a second recess for receiving an amount of leaked treatment liquid which has leaked from a second connecting portion between said second ink jet head and said treatment liquid storing tank, said table being disposed below said carriage at a home position of said carriage;

a third recess for receiving the amount of leaked ink and the amount of leaked treatment liquid which overflow from said first and second recesses, said third recess consisting of transparent materials provided in said table;

a sensor for sensing a presence or an absence of the amount of leaked ink and the amount of leaked treatment liquid which has overflowed into said third recess;

controlling means for apprising a sensing information by said sensor and for stopping a printing operation; and a first drain passage being connected to said first recess of said table and a second drain passage being connected to said second recess of said table, wherein a plurality of ejecting energy generating portions for ejecting the ink are arranged on said first ink jet head, and a plurality of ejecting energy generating portions for ejecting the treatment liquid are arranged on said second ink jet head, each of said ejecting energy generating portions including an electrothermal transducer for generating thermal energy so as to cause film boiling.

* * * * *

UNITED STATES PATENT AND TRADEMARK OFFICE

CERTIFICATE OF CORRECTION

PATENT NO. : 6,328,414 B1
DATED : December 11, 2001
INVENTOR(S) : Hiroshi Yoshino It is certified that error appears in the above-identified patent and that said Letters Patent is hereby corrected as shown below:

Title page,
Item [56], References Cited, FOREIGN PATENT DOCUMENTS, "58128862" should read -- 58-128862 --.

Column 1,
Line 28, "No. 15-128862." should read -- No. 58-128862. --.

Column 2,
Line 60, "ink-leak" should read -- ink leak --.

Column 10,
Line 25, "1Bkdesignate" should read -- 1Bk designate --.

Column 11,
Line 49, "addition;" should read -- addition, --.

Column 14,
Line 42, "Thus;" should read -- Thus, --.

Column 17,
Line 61, "and," should read -- and --.

Column 18,
Line 33, "ink," should read -- ink --.

UNITED STATES PATENT AND TRADEMARK OFFICE

CERTIFICATE OF CORRECTION

PATENT NO. : 6,328,414 B1
DATED : December 11, 2001
INVENTOR(S) : Hiroshi Yoshino It is certified that error appears in the above-identified patent and that said Letters Patent is hereby corrected as shown below:

Column 20,
Line 19, “detachable” should read -- detachably --;
Line 33, “recess,” should read -- recesses, --; and
Line 35, “for,” should read -- for --.

Signed and Sealed this

Tenth Day of September, 2002

*Attest:*

*Attesting Officer*

JAMES E. ROGAN
*Director of the United States Patent and Trademark Office*